US008432315B2

(12) United States Patent
Chung et al.

(10) Patent No.: US 8,432,315 B2
(45) Date of Patent: Apr. 30, 2013

(54) PATCH ANTENNA

(75) Inventors: Tae Inn Chung, Gyeongsangbuk-do (KR); Byoung-Nam Kim, Gyeonggi-do (KR); Tae-Hwan Yoo, Seoul (KR); Young-Hun Park, Chungcheongbuk-do (KR)

(73) Assignees: Kia Motors Corporation, Seoul (KR); Ace Technologies Corporation, Incheon (KR); Hyundai Motor Company, Seoul (KR)

( * ) Notice: Subject to any disclaimer, the term of this patent is extended or adjusted under 35 U.S.C. 154(b) by 389 days.

(21) Appl. No.: 12/823,340

(22) Filed: Jun. 25, 2010

(65) Prior Publication Data

US 2011/0128186 A1 Jun. 2, 2011

(30) Foreign Application Priority Data

Dec. 1, 2009 (KR) ..... 10-2009-0117987

(51) Int. Cl.
*H01Q 9/04* (2006.01)

(52) U.S. Cl.
USPC ..... 343/700 MS; 343/767; 343/834

(58) Field of Classification Search ..... 343/767, 343/834, 700 MS, 711, 725, 729
See application file for complete search history.

(56) References Cited

U.S. PATENT DOCUMENTS

| | | | | |
|---|---|---|---|---|
| 6,424,299 | B1 | 7/2002 | Cha et al. | |
| 6,452,549 | B1 * | 9/2002 | Lo | 343/700 MS |
| 6,697,019 | B1 * | 2/2004 | Hyuk-Joon et al. | 343/700 MS |
| 2005/0206568 | A1 * | 9/2005 | Phillips et al. | 343/700 MS |
| 2009/0058731 | A1 * | 3/2009 | Geary et al. | 343/700 MS |
| 2010/0231475 | A1 * | 9/2010 | Ou et al. | 343/776 |
| 2012/0038529 | A1 * | 2/2012 | Yoo et al. | 343/767 |

FOREIGN PATENT DOCUMENTS

| | | | |
|---|---|---|---|
| JP | 2000-165135 | A | 6/2000 |
| JP | 2003-087049 | A | 3/2003 |
| JP | 2006-191574 | A | 7/2006 |
| KR | 10-2002-0084399 | | 11/2002 |
| KR | 10-2005-0075966 | A | 7/2005 |
| KR | 10-2006-0081773 | | 7/2006 |
| KR | 10-2007-0034924 | A | 3/2007 |
| KR | 10-2009-0093195 | A | 9/2009 |

* cited by examiner

*Primary Examiner* — Don Le
(74) *Attorney, Agent, or Firm* — Edwards Wildman Palmer LLP; Peter F. Corless

(57) ABSTRACT

The present invention relates to a technology for forming a patch antenna generating both linearly and circularly polarized waves at the same time, so as to reduce a propagation loss during transmission/receiving operations between a circularly polarized antenna and a linearly polarized antenna.

11 Claims, 1 Drawing Sheet

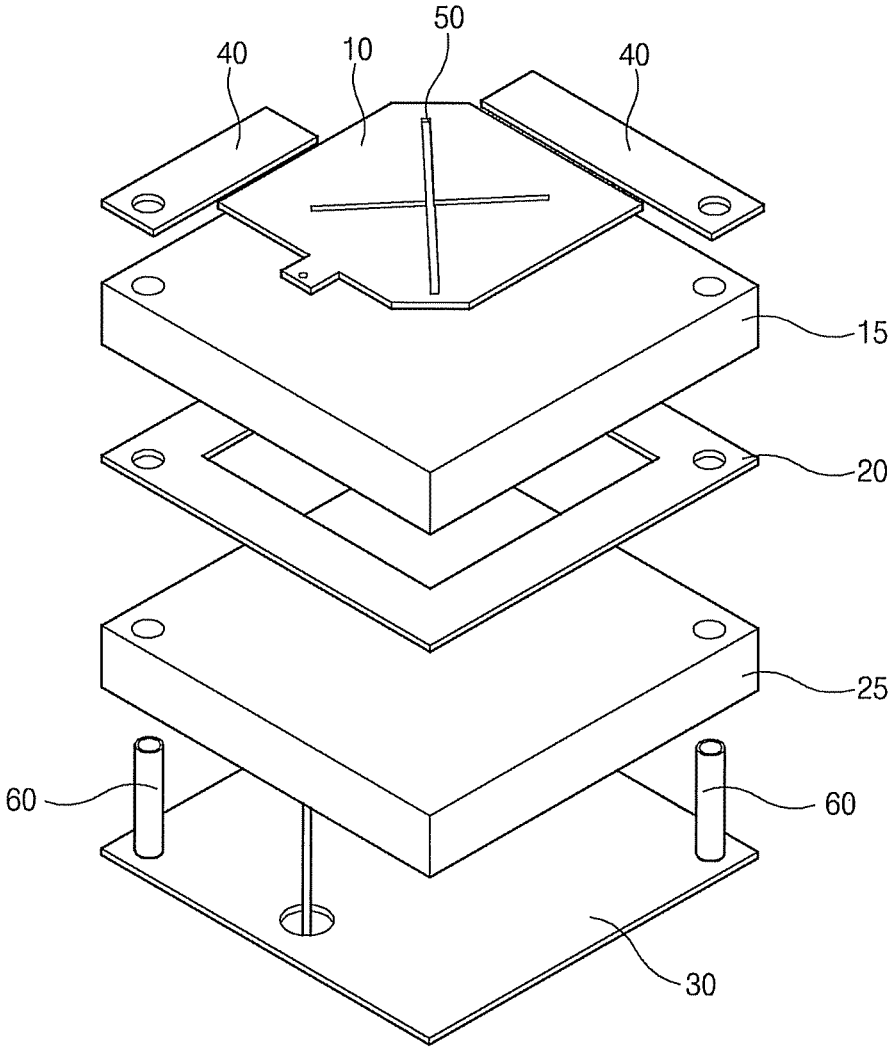
50
40
10
40
15
20
25
60
60
30

PATCH ANTENNA

CROSS-REFERENCE TO RELATED APPLICATION

This application claims under 35 U.S.C. §119(a) the benefit of Korean Patent Application No. 10-2009-117987 filed on Dec. 1, 2009 the entire contents of which are incorporated herein by reference.

BACKGROUND OF THE INVENTION

The present invention relates, in general, to a patch antenna; and in particular, to a patch antenna generating both linearly and circularly polarized waves at the same time.

As wireless communication techniques have advanced, information communication terminals, such as mobile phones, PDAs, GPS receivers, etc., have been made available to many. These information communication terminals typically use a small, light patch antenna of a thin planar design. In general, the size of the patch antenna is in proportion to the wavelength of an intended frequency (e.g., the length of one side of the patch antenna is 0.5λ). Preferably, dielectric substrates having a high specific dielectric constant are used to make patch antennas smaller, provided the same frequency is used. However, the use of dielectrics having a high specific dielectric constant may degrade radiation performance of the antenna as the frequency band becomes narrow. Further, the use of dielectrics with a high dielectric constant may also increase the height of a patch structure constituting the antenna proportionally to the reduction ratio of dielectrics, which may impair the frequency band and gain of an antenna being used, and also may set height restrictions on the antenna. Furthermore, when the specific dielectric constant of dielectrics increases, the height of an antenna also increases proportionally to the reduction ratio thereof. This may lead to an increase in manufacturing costs and a drop in production yield. Overall, using dielectrics with a high specific dielectric constant places limitations on the size of an antenna.

As a result, patch antennas of various structures have been proposed.

The conventional patch antenna has a patch surface where a circularly polarized wave occurs in the right or left direction (RHCP or LHCP) by changing feeding position or patch structure.

Generally, when it comes to transmission/receiving operations between patch antennas, patch antennas having the same rotation direction (RHCP, LHCP) are preferably used to minimize the occurrence of a propagation loss between transmission/receiving antennas. However, when a circularly polarized antenna and a linearly polarized antenna are used for transmission/receiving operations, one would face, on one hand, a propagation loss of −3 dB, and on the other hand, the necessity of improving the transmission power and the receiving sensitivity in order to compensate for the loss of two polarized waves.

Accordingly, there remains a need in the art for patch antennas that do not generate any propagation loss.

The above information disclosed in the Background section is only for enhancement of understanding of the background of the invention and therefore it may contain information that does not form the prior art that is already known in this country to a person of ordinary skill in the art.

SUMMARY OF THE INVENTION

The present invention features, in preferred aspects, a patch antenna that does not generate any suitable propagation loss during transmission/receiving operations between a circularly polarized antenna and a linearly polarized antenna.

A patch antenna according to an exemplary embodiment of the present invention preferably comprises a first radiator generating a circularly polarized wave; a second radiator suitably disposed below the first radiator at a fixed distance therefrom, the second radiator generating a linearly polarized wave; and a reflecting plate suitably disposed below the second radiator at a fixed distance therefrom.

Preferably, a first FR (Frame Retardant) 4 substrate is further comprised below the first radiator, and a second FR4 substrate is further comprised below the second radiator.

In one embodiment, the first radiator preferably includes a X-shaped primary slot, and a bar-shaped secondary slot adjacent to the first radiator. In a further preferred embodiment, the secondary slot is provided to a lateral face of the first reflector and to another face perpendicular to the lateral face. Preferably, the second reflector is formed in a rectangular strip shape.

The above-described patch antenna according to preferred embodiments of the present invention has the following advantages.

In certain exemplary embodiments, with a small antenna and an expandable axial ratio frequency band, it becomes suitably easier to do frequency conversion, thereby making the antenna adaptable to any system.

In other exemplary embodiments, as both linearly and circularly polarized waves can be suitably generated at the same time, even one signal out of the circularly and linearly polarized waves is sufficient for smooth transmission/receiving operations without causing a propagation loss.

In still other preferred exemplary embodiments, the use of an X-shaped slot can suitably stabilize the axial ratio of a circularly polarized wave, and as a result thereof, the linearly polarized wave which is generated at the same time as the circularly polarized wave is also stabilized.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other features of the present invention will now be described in detail with reference to certain exemplary embodiments thereof illustrated by the accompanying drawings which are given hereinafter by way of illustration only, and thus are not limitative of the present invention, and wherein:

FIG. 1 is a perspective view of a patch antenna according to an exemplary embodiment of the invention.

It should be understood that the appended drawings are not necessarily to scale, presenting a somewhat simplified representation of various preferred features illustrative of the basic principles of the invention. The specific design features of the present invention as disclosed herein, including, for example, specific dimensions, orientations, locations, and shapes will be determined in part by the particular intended application and use environment.

DETAILED DESCRIPTION OF THE EMBODIMENTS

As described herein, the present invention includes a patch antenna comprising a first radiator generating a circularly polarized wave, and a second radiator generating a linearly polarized wave, and a reflecting plate.

In one embodiment, the second radiator is disposed below the first radiator at a fixed distance therefrom.

In another embodiment, the reflecting plate is disposed below the second radiator at a given distance therefrom In another further embodiment, the reflecting plate is a layered structure.

Hereinafter, embodiments of the present invention will now be described in more detail with reference to accompanying drawings.

FIG. 1 is a perspective view of a patch antenna according to an exemplary embodiment of the invention.

According to a preferred exemplary embodiments and referring to FIG. 1, for example, a first radiator 10, a first FR4 substrate 15, a second radiator 20, a second FR4 substrate 25 and a reflecting plate 30 are suitably arranged in order at a fixed distance from one another. Elements of such a patch antenna according to exemplary embodiments of the present invention are explained below.

According to preferred embodiments of the present invention, the first radiator 10 is a patch surface generating a circularly polarized wave, preferably, in particular, it generates a circularly polarized wave when it is in the positive polarity(+pole) with a period of 0.5λ and in the negative polarity(−pole) with a period of 0.5λ, while the negative polarity occurring in proportion to the wavelength and undergoing temporal intersection each other. In preferred embodiments, the expression "circularly polarized wave" is intended to refer to a polarity of the direction of a wave in which the tip of a vector representing the magnitude and direction of an electric field traces a circle on the plane at right angles to the direction of wave propagation.

According to further preferred embodiments, frequency conversion slots 40 are suitably provided in contiguity with the first radiator 10. Preferably, the frequency conversion slots 40 are suitably formed in a bar shape. In a further preferred embodiment, one of the frequency conversion slots 40 is suitably disposed adjacent to a first lateral face of the first radiator 10, and another frequency conversion slot 40 is suitably disposed adjacent to a second lateral face of the first radiator 10. In further preferred embodiments, the first lateral face and the second lateral face are preferably disposed in planarly perpendicular to each other.

Accordingly, in certain embodiments of the present invention, the thus configured frequency conversion slots 40 are suitably used to generate multi-band circularly and linearly polarized waves, depending on varying lengths of the slot.

According to other further preferred embodiments, an X-shaped slot 50 is included inside the first radiator 10. Preferably, the X-shaped slot 50 serves to suitably reduce the patch face to 0.3λ and to suitably expand the frequency band where an axial ratio, a performance factor of the circularly polarized wave, is suitably formed.

Preferably, in further embodiments, because the first radiator 10 is suitably connected with vias 60 after two reflecting plates 30, i.e. the second radiator 20 and the reflecting plate 30, are suitably layered, the area of the reflecting plate 30 gets relatively larger. Thus, according to preferred embodiments of the present invention, antenna efficiency can be suitably improved and stability characteristics of a circularly polarized wave of a built-in antenna in a given system can be suitably ensured.

In further preferred embodiments of the present invention, the first FR4 substrate 15 is suitably disposed below the first radiator 10. Preferably, the first FR4 substrate 15 is a glass epoxy laminate, which is made up of a material having a normal dielectric constant (4.4-4.8). Further, its threshold temperature is preferably in a range of 120-130° C., and is slightly affected by temperature according to its thickness.

In another further embodiment, the second radiator 20 is suitably disposed below the first FR4 substrate 15. The second radiator 20 is preferably formed in a suitably rectangular strip shape. Preferably, the second radiator 20 serves as the reflecting plate 30 of the first radiator 10 and at the same time as a patch surface generating a linearly polarized wave. According to further preferred embodiments, the second radiator 20 generates a linearly polarized wave when it is in the negative polarity and in the positive polarity with a period of 0.5λ. According to preferred embodiments of the present invention, the expression "linearly polarized wave" is meant to refer to a polarity of a wave in which the tip of a vector representing the magnitude and direction of an electric field traces suitably vertically or horizontally on the plane at right angles to the direction of wave propagation.

In further preferred embodiments, the second FR4 substrate 25 is suitably disposed below the second radiator 20. Here, the second FR4 substrate 25 has the same configuration as the first FR4 substrate 15. Preferably, it is a glass epoxy laminate, which is made up of a material having a normal dielectric constant (4.4-4.8). Further, its threshold temperature is in a range of 120-130° C., and is slightly affected by temperature according to its thickness.

According to further preferred embodiments, the reflecting plate 30 is suitably disposed below the second FR4 substrate 25. Preferably, the reflecting plate 30 is suitably used as the reflecting plate 30 of the first radiator 10 and also generates a linearly polarized wave, in combination with the second radiator 20. According to other further preferred embodiments, the reflecting plate 30 is responsible for uniformly reflecting incoming signals from the patch surface. Thus, it is preferably made of metal materials. For instance, in certain exemplary embodiments, it can be formed of an aluminum-based material.

According to other preferred embodiments, the layered structure of the frequency conversion slots 40, first FR4 substrate 15, second radiator 20, second FR4 substrate 25 and reflecting plate 30 is suitably interconnected by the vias 60. Preferably, in certain exemplary embodiments, the vias 60 are suitably formed at the corners of the layered structure, and there are preferably provided two vias in a diagonal direction.

As explained so far, the use of a patch antenna capable of generating both circularly and linearly polarized waves at the same time enables to reduce a propagation loss during transmission/receiving operations between a circularly polarized antenna and a linearly polarized antenna.

It will be apparent to those skilled in the art that various modifications and variation can be made in the present invention without departing from the spirit or scope of the invention. Thus, it is intended that the present invention covers the modifications and variations of this invention provided they come within the scope of the appended claims and their equivalents.

What is claimed is:

1. A patch antenna comprising:

a first radiator generating a circularly polarized wave and includes a first slot therein;

a second radiator disposed below the first radiator at a given distance therefrom, the second radiator generating a linearly polarized wave; and a reflecting plate disposed below the second radiator at a given distance therefrom, wherein a second slot is adjacent to the first radiator.

2. The patch antenna of claim 1, further comprising a first FR4 substrate below the first radiator.

3. The patch antenna of claim 1, further comprising a second FR4 substrate below the second radiator.

4. The patch antenna of claim 1, wherein the first slot is X-shaped.

5. The patch antenna of claim 1, wherein the second slot is provided to a lateral face of the first reflector and to another face perpendicular to the lateral face.

6. The patch antenna of claim 1, wherein the second reflector is formed in a rectangular strip shape.

7. The patch antenna of claim 1, wherein the second slot is bar-shaped.

8. A patch antenna comprising a layered structure that includes:

a first radiator generating a circularly polarized wave including a first slot therein;

a second radiator disposed below the first radiator, the second radiator generating a linearly polarized wave; and a reflecting plate disposed below the second radiator, wherein the layered structure is connected by a via and a second slot is adjacent to the first radiator.

9. The patch antenna of claim 8, wherein the via is formed at the corner of the layered structure.

10. The patch antenna of claim 8, wherein two vias are formed in a diagonal direction.

11. The patch antenna of claim 8, wherein the second slot is bar-shaped.

* * * * *